US011691161B2

(12) United States Patent
Tapocik

(10) Patent No.: US 11,691,161 B2
(45) Date of Patent: Jul. 4, 2023

(54) SPRAYER WITH A SIX-HOLE SPRAY PATTERN

(71) Applicant: Bryan Tapocik, Highland, CA (US)

(72) Inventor: Bryan Tapocik, Highland, CA (US)

(73) Assignee: Innovative Product Brands, Inc., Highland, CA (US)

( * ) Notice: Subject to any disclaimer, the term of this patent is extended or adjusted under 35 U.S.C. 154(b) by 19 days.

(21) Appl. No.: 16/951,262

(22) Filed: Nov. 18, 2020

(65) Prior Publication Data

US 2021/0078019 A1 Mar. 18, 2021

Related U.S. Application Data

(63) Continuation-in-part of application No. 15/969,388, filed on May 2, 2018, now abandoned.

(51) Int. Cl.
*B05B 1/02* (2006.01)
*B05B 11/10* (2023.01)

(52) U.S. Cl.
CPC ..... *B05B 1/02* (2013.01); *B05B 11/1001* (2023.01); *B05B 11/1047* (2023.01); *B05B 11/1066* (2023.01); *B05B 11/1073* (2023.01)

(58) Field of Classification Search
CPC .. B05B 1/14; B05B 1/16; B05B 1/185; B05B 1/06; B05B 11/30; B05B 11/1047; B05B 11/1073; B05B 11/1001; B05B 11/1066; B05B 1/02
See application file for complete search history.

(56) References Cited

U.S. PATENT DOCUMENTS

| | | | | |
|---|---|---|---|---|
| 5,878,964 | A * | 3/1999 | Hansen | B05B 1/14 239/566 |
| 6,158,674 | A | 12/2000 | Humpheys | |
| 7,481,382 | B2 * | 1/2009 | Christ | B65D 83/28 239/548 |
| 7,748,647 | B2 | 7/2010 | Cleret et al. | |
| 9,463,476 | B2 | 10/2016 | Greiner-Perth et al. | |
| 2004/0007597 | A1 * | 1/2004 | Masuzzo | B05B 11/3094 222/321.9 |
| 2008/0302827 | A1 * | 12/2008 | Gerrish | B05B 15/60 222/173 |

FOREIGN PATENT DOCUMENTS

| | | | |
|---|---|---|---|
| CN | 103550804 | A | 2/2014 |
| DE | 29900634 | U1 | 1/1997 |

* cited by examiner

*Primary Examiner* — Christopher R Dandridge
(74) *Attorney, Agent, or Firm* — Minta Law Group LC; Veronica-Adele R. Cao

(57) ABSTRACT

The present invention is an improved nozzle for spraying viscous substances which includes the following key elements: (1) the nozzle includes a round hole at the nozzle middle-center location; and (2) the center round hole is surrounded by five circumferential modified trapezoid shaped hole openings, with each of the modified trapezoid shaped hole openings having a pair of divergent sidewalls with an arcuate top wall and a smaller acuate bottom wall and set at a distance separated from each other at seventy-two degrees in a circle around the center opening. The distance from the center of each circumferential opening to the middle center opening is also the same. The present invention will enable the spraying of heavy viscous substances and gels.

15 Claims, 16 Drawing Sheets

SPRAYER WITH A SIX-HOLE SPRAY PATTERN

CROSS-REFERENCE TO RELATED APPLICATION

This patent application is a continuation-in-part application Ser. No. 15/969,388 filed on May 2, 2018.

BACKGROUND OF THE INVENTION

1. Field of the Invention

The field of the invention relates to spray bottles. Specifically, the present invention relates to spray bottles that are used to spray gels or liquids that have high viscosity.

2. Description of the Prior Art

The following six patents are the closest prior art known to the inventor:

1. U.S. Pat. No. 6,158,674 issued to Ronald O. Humphreys on Dec. 12, 2000 for "Liquid Dispenser With Multiple Nozzles".
2. U.S. Pat. No. 7,481,382 issued to Stefan Christ on Jan. 27, 2009 for "Outlet Hood For Device For Spraying A Highly Viscous Liquid".
3. U.S. Pat. No. 7,748,647 issued to Bernard Clerget et al. on Jul. 6, 2010 for "Spraying Device And Use Of This Device".
4. U.S. Pat. No. 9,463,476 issued to Juergen Greiner-Perth et al. on Oct. 11, 2016 for "Dispenser For Dispensing Liquids".
5. German Patent No. DE29900634U1 issued to Werner & Mertz on Jan. 30, 1997 for "Spraying Employment for a Bottle".
6. Chinese Patent No. CN103550804A issued to Song Zhengquan on Feb. 5, 2014 for "Medical Sterilization Spray Bottle".

None of the prior art discloses an apparatus specifically designed for spraying high viscous liquids or gel-based substances.

SUMMARY OF THE INVENTION

The present invention is a spray bottle specifically designed for allowing high viscous liquids and gels to be sprayed. This improved spray bottle provides a six-hole sprayer that allows the spraying of both gels and high viscous liquids. Further, this improved spray bottle provides a central chamber that stores a liquid, and a pump having an actuator at a proximal end and a straw with an opening at a distal end to access the central chamber. The uniqueness involves the nozzle having six holes with a unique spray pattern wherein there is a central hole and five spaced apart perimeter holes. Each perimeter hole is spaced apart from an adjacent perimeter hole by the same distance. Separately, the distance between each respective perimeter hole and the central holes is also the same. The distances between adjacent perimeter holes and the distance from each perimeter hole to the central hole may be the same or may be different. This unique spray pattern combined with the size of the holes enables high viscous and gel-type substances to be sprayed which cannot be sprayed out with a single hole sprayer.

The present invention is an improved spray bottle specifically designed for allowing high viscous liquids and gels to be sprayed. Numerous spray bottles allow for the spraying of low viscous liquids to be discharged in a mist or stream with the depressing of a pump. However, high viscous liquids or gels cannot easily be sprayed by conventional sprayers. Through extensive research and trial and error of the number of holes, the size of the holes and the spacing between the holes; the present inventor has discovered a pattern and size of holes that permit the spraying of both high viscous liquids and gels.

Through extensive testing and experimentation ordered by inventor Bryan Tapocik, setting forth experiment requirements and configuration of spray nozzle holes and distribution patterns achieved, it was discovered that a six hole nozzle opening with specific hole shape, orientation and size achieved an optimal spray for viscous and gel substances. The viscous gel substances which are used with the present invention six-hole sprayer include hand sanitizer, pain relieving spray, sunscreen and cooking oil.

It was discovered through experimentation that a new nozzle opening design for an optimal viscous substance spray pattern was obtained. The new and improved nozzle includes the following key elements: (1) the nozzle includes a round hole at the nozzle middle-center location, the round hole having a preferred diameter of 0.500 mm and a preferred surface area of 0.196 mm squared; (2) the center round hole is surrounded by five circumferential modified trapezoid shaped hole openings, with each of the modified trapezoid shaped hole openings having a pair of divergent sidewalls with an arcuate top wall and a smaller acuate bottom wall. The five circumferential modified trapezoid shaped openings, also called orifices, are spaced apart by 1.23 mm with a top and bottom radius concentric to the center hole (also called orifice) and evenly spaced D3 at 72 degrees from the center hole's vertical axis and with each of the five circumferential modified quadrilateral shaped openings having the same surface area of 0.196 mm squared. The distance from a middle-center point of the round center opening to a middle center point of each of the five circumferential modified quadrilateral shaped openings is between 0.54 mm and 0.60 mm; and (3) with the improved nozzle design, the viscous spray pattern was consistent as a jet spray traveling from two inches to 4 inches for a viscous substance having a viscosity of at least 100 psi.

It is an object of the present invention to provide a sprayer with a six-hole spray pattern that allows the spraying of both gels and high viscous liquids.

It is a further object of the present invention to provide a central chamber that stores a liquid, and a pump including a straw or longitudinal hollow tube with an actuator at a proximal end of the longitudinal hollow tube and an open distal end to gain access to the central chamber. The contents in the chamber is sprayed out of the six holes through the actuator sucking the contents into the longitudinal hollow tube and causing the contents to be ejected or sprayed through the unique sprayer with a jet spray from a six-hole spray pattern.

It is also an object of the present invention to provide a spray bottle that has specifically six holes with a specific surface area for each of the holes.

Further novel features and other objects of the present invention will become apparent from the following detailed description and discussion.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Figure 1:
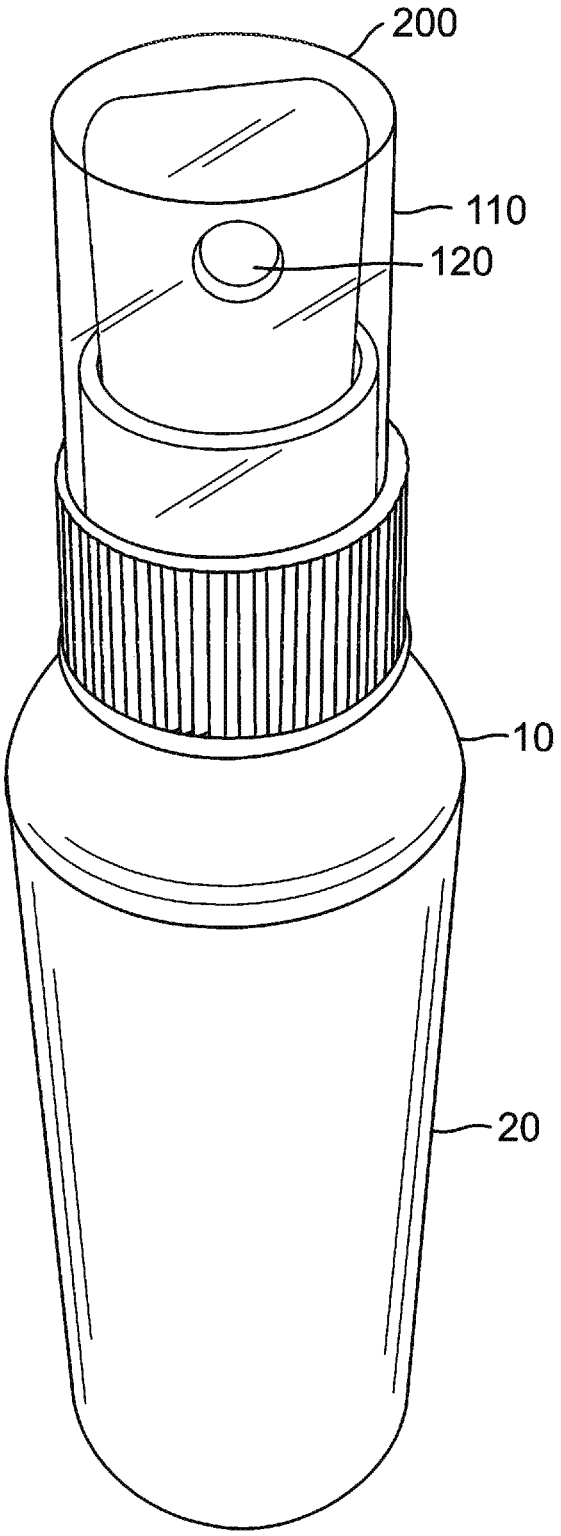
FIG. 1 is a front perspective view of the present invention sprayer with a six-hole spray pattern with the pump sprayer assembly affixed on top of the liquid container and a removable transparent cap placed over the pump sprayer, the spray nozzle removed to show the opening in the actuator where the spray nozzle is located.

Referring to FIG. 1, there is illustrated the present invention six-hole sprayer 10 completely assembled with a liquid container 20 located on the lower portion of the invention. Directly above the liquid container 20 is the pump sprayer assembly 100 (see FIG. 2) with sprayer cap 200 located above pump sprayer assembly 100 and above the container 20.

Figure 2:
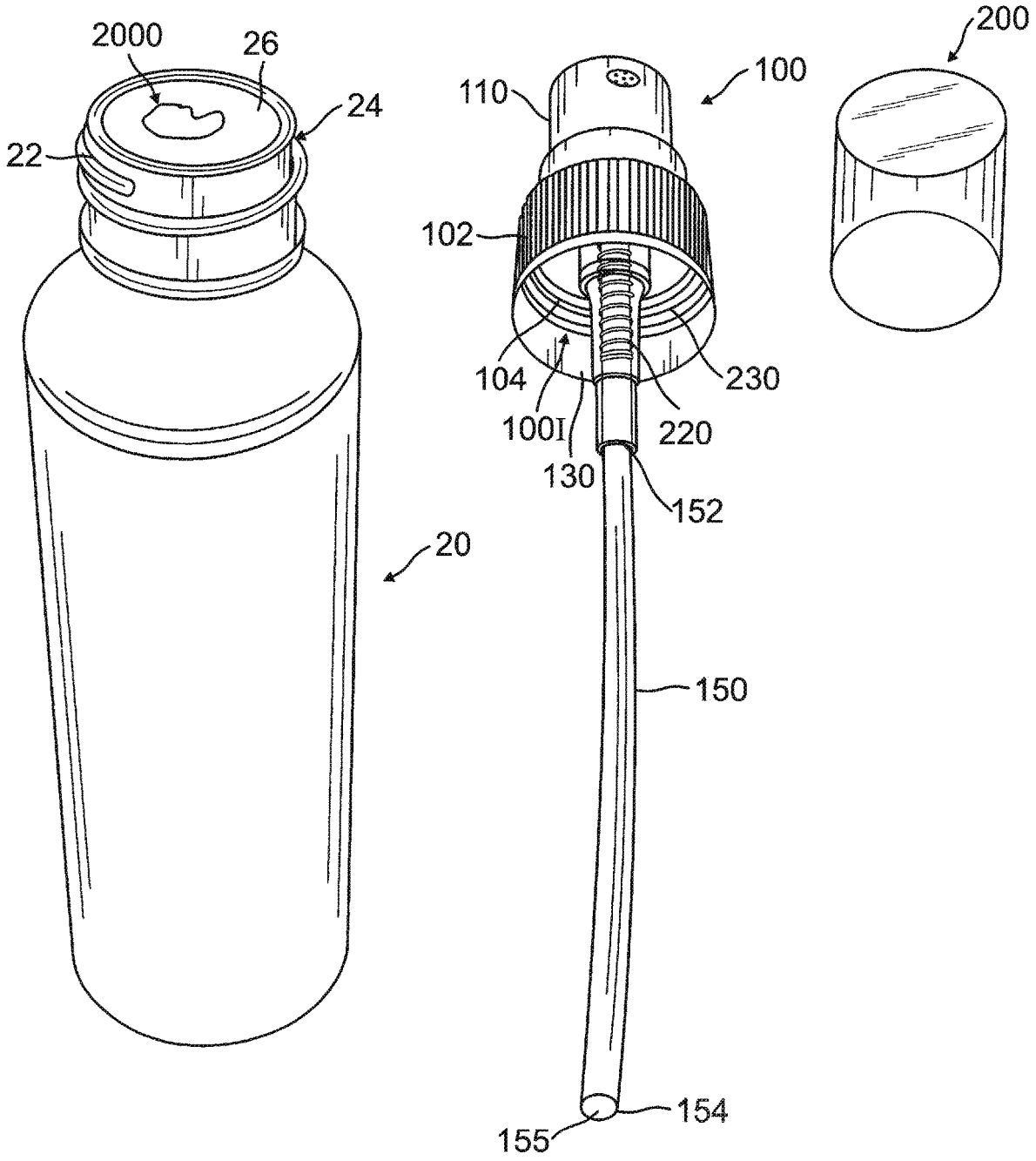
FIG. 2 is an exploded view of the present invention sprayer with a six-hole spray pattern illustrating the pump sprayer assembly removed from the liquid container and the removable cap resting beside the pump sprayer assembly.
Figure 3:
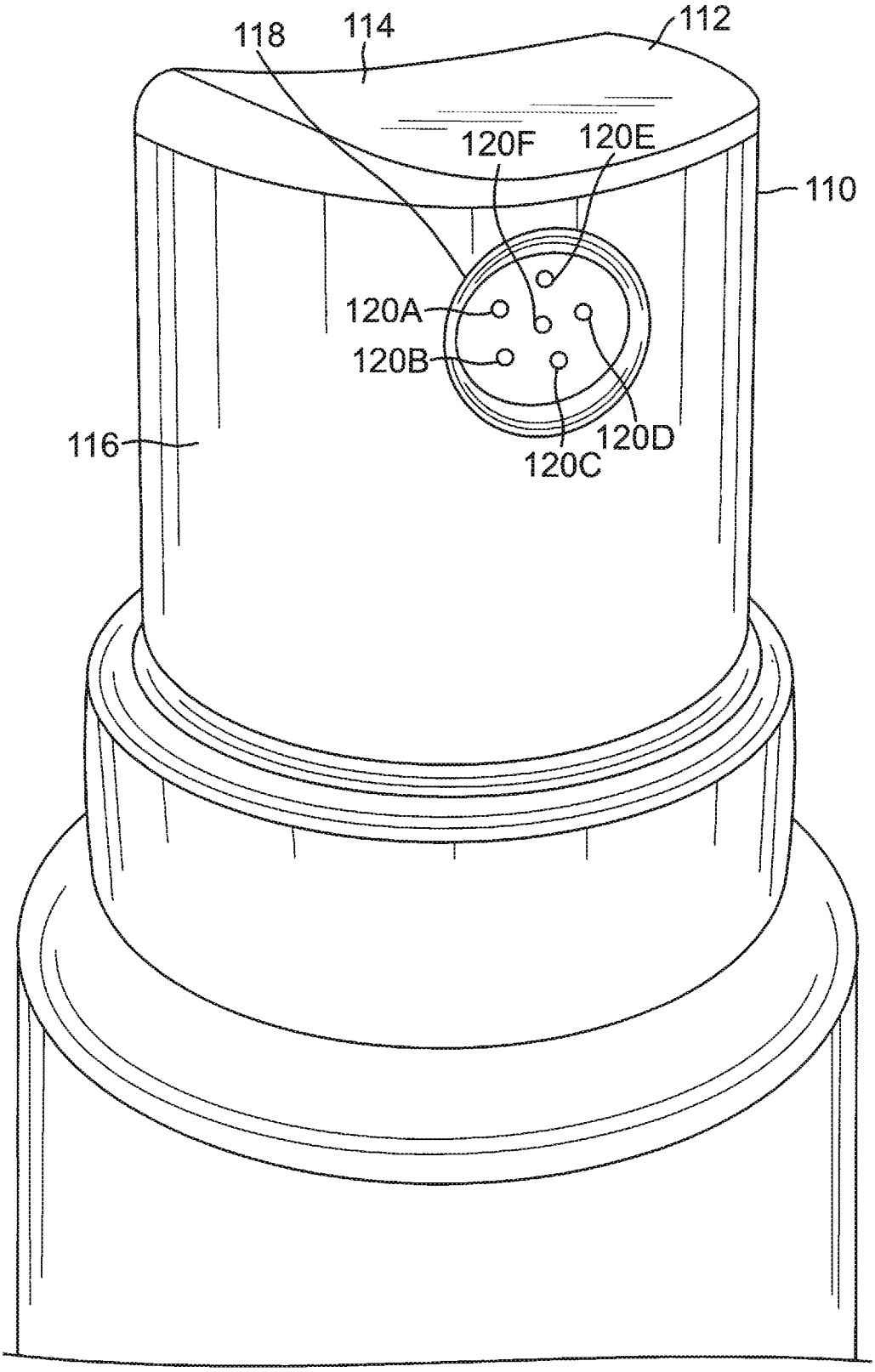
FIG. 3 is a close up view of the pump sprayer assembly illustrating the six holes that extend away from one of the pump sprayer's vertical walls and located just below the actuator.
Figure 6:
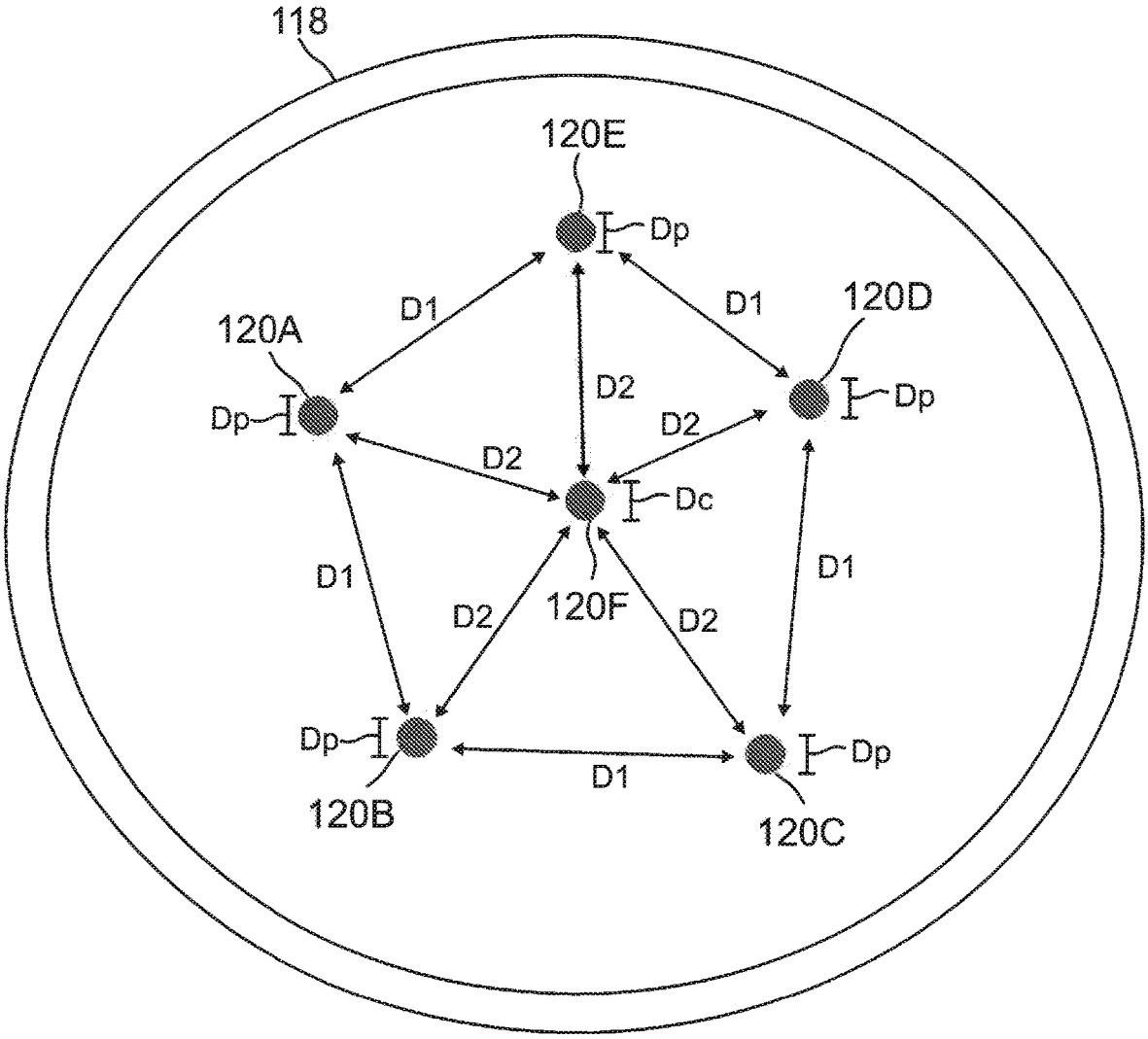
FIG. 6 is a schematic of the nozzle of the sprayer with a six-hole spray pattern illustrating the distance between the holes.

Referring to FIG. 3, pump sprayer assembly 100 has a removable actuator 110 having a predominantly flat actuator perimeter top surface 112 with a central top concave portion 114 shaped to accept a user's finger or thumb. Removable actuator 110 extends from flat actuator perimeter top surface 112 downward to a first actuator vertical circumferential wall 116. As illustrated in FIG. 3, first actuator vertical circumferential wall 116 extends inwardly to an interior vertical actuator wall or nozzle 118. As illustrated in FIGS. 3 and 6, interior vertical actuator wall or nozzle 118 includes six hole openings (120A, 120B, 120C, 120D, 120E, and 120F) through which the substance 2000 (see FIG. 2) in the container 20 passes through and exits the present invention six-hole sprayer 10 when removable actuator 110 is depressed by a user.

Referring to FIG. 2, pump sprayer assembly 100 is located above liquid container 20. Pump sprayer assembly 100 is removably affixed to liquid container 20 by liquid container threads 22 on its nozzle 24 that mate with pump sprayer assembly threads 230 on the interior surface 130 of cap 102 of pump sprayer assembly 100. These threads may be either male or female interlock threads on either the liquid container nozzle 24 or pump sprayer assembly 100. Liquid container 20 has an opening 26 that straw or longitudinal hollow tube 150 extends into to extract substance 2000. Straw and longitudinal hollow tube refer to the same part 150.

Figure 4:
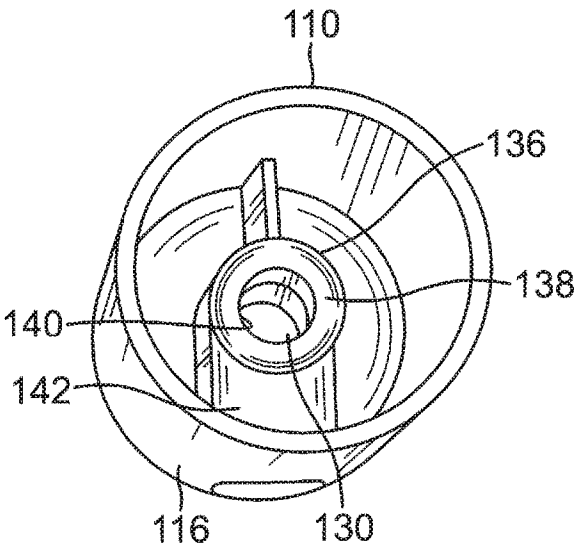
FIG. 4 is a close-up separated view of the top portion of the pump sprayer assembly with the actuator removed and the actuator positioned adjacent to the pump sprayer assembly with the actuator's top surface facing downward.
Figure 4:
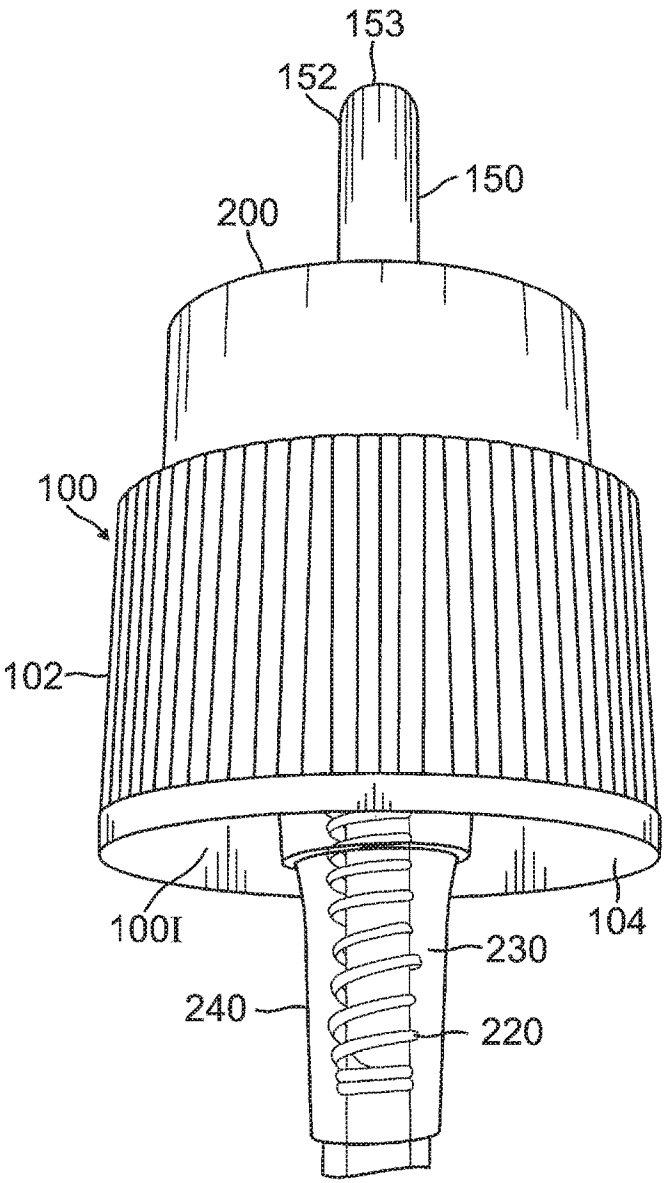

Referring to FIGS. 2 and 4, pump sprayer assembly 100 has a straw 150 that extends from a straw proximal end 152 to a straw distal end 154 having a distal opening 155. In the fully assembled condition as illustrated in FIG. 1, straw proximal end 152 has a straw upper opening 153 retained within an actuator interior vertical circumferential wall 136. Actuator interior vertical circumferential wall 136 extends upwardly from a vertical chamber lower elevation or bottom elevation 138 to a vertical chamber upper elevation 140. At vertical chamber upper elevation 140, actuator interior circumferential vertical wall 136 transitions to an actuator interior circumferential horizontal wall 142. Collectively, actuator interior circumferential vertical wall 136 and interior circumferential horizontal wall 142 form an integrally connected L-shaped valve that encloses actuator interior chamber 130 and allows gel or viscous liquid 2000 to pass from opening 155 in distal end 154 of straw 150 through straw 150 and up through straw proximal end 152 through opening 153 and to hole openings 120A, 120B, 120C, 120D, 120E, and 120F. Hole opening 120F is centrally located on actuator opening 120 (see FIG. 1) of pump sprayer assembly 100 and hole openings 120A, 120B, 120C, 120D, and 120E are positioned equidistant around central hole opening 120F. The shape of hole openings 120A, 120B, 120C, 120D, 120E, and 120F is generally circular. However, it is within the spirit and scope of this invention for these holes to be of shapes other than circular such as rectangular, trapezoidal, octagonal, or other commonly known polygons.

Referring to FIGS. 2 and 4, pump sprayer assembly 100 has a pump circumferential exterior wall 102 and a pump circumferential interior wall 104 that surrounds an interior chamber 100I. Centrally located within interior chamber 100I is the fluid pump 200. Fluid pump 200 consists of a piston 230 and a spring 220 that are housed inside of a cylinder 240. The present invention is not the invention of a fluid pump, but rather the improvement over the prior art fluid pump by extensive research and design to allow a gel or high viscous liquid to be sprayed from a pump. Gels and high viscous liquids through the present invention design which includes the size, location, and number of these holes, allows gels and high viscous liquids to be efficiently sprayed. The details of the size, location, and number of these holes will be discussed below.

Figure 5A:
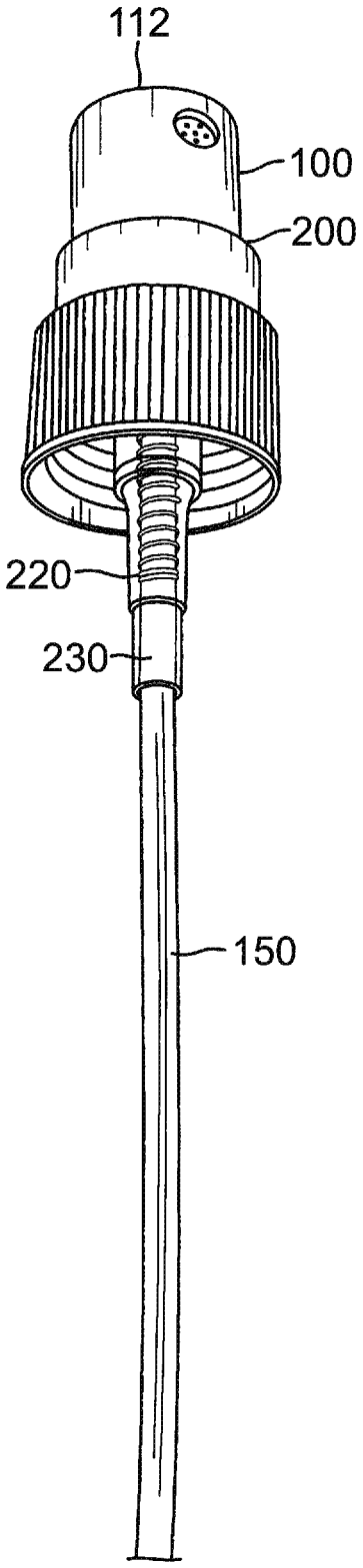
FIG. 5A is a view of the pump sprayer assembly in the expanded condition with the actuator in the resting position prior to being depressed.
Figure 5B:
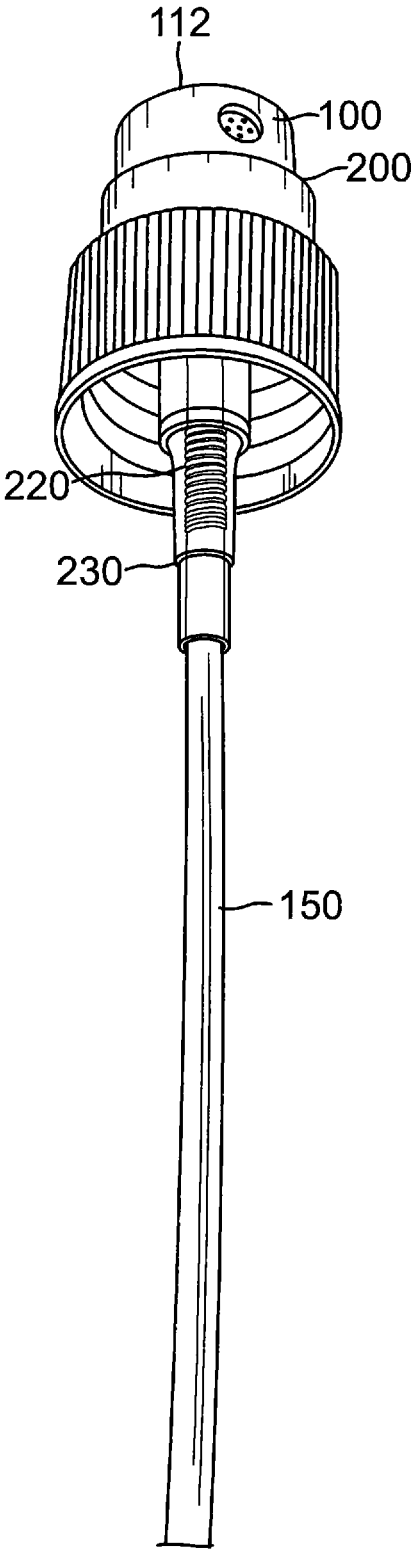
FIG. 5B is a view of the pump sprayer assembly in the compressed condition after the actuator has been depressed.

Referring to FIGS. 5A (actuator released) and 5B (actuator depressed), the operation of fluid pump 200 is performed by a user depressing interior surface 114 surrounded by flat actuator top surface 112 of actuator 110. When actuator 110 is depressed, it forces piston 200 (FIG. 4) to compress spring 220 which reduces the amount of volume in cylinder 230. This reduction of volume in cylinder 230 forces the liquid or gel within the upper portion of straw 150 to be forced upward through interior chamber 130, through opening 153 and out of hole openings 120A, 120B, 120C, 120D, 120E, and 120F. When actuator 110 is released, piston 200 (FIG. 5B) moves upward from the force of spring 220 moving from a compressed condition to its initial or starting position. The movement of piston 200 downward creates a suction force that pulls gel or high viscous liquid 2000 into opening 155 of straw distal end 154, through straw 150 to straw proximal end 152 and through straw opening 153.

Referring to FIG. 6, there is illustrated a schematic of the nozzle 118 of the present invention. The improved nozzle includes one centrally located hole opening 120F and five outer hole openings 120A, 120B, 120C, 120 D, and 120E around the one centrally located hole opening 120F. Each of the openings is the same size. Each opening for each of the five outer hole openings is positioned a distance D2 equidistant away from the one centrally located hole opening 120F. Each outer hole opening is positioned an equal distance D1 apart from each adjacent outer hole opening. With this unique spray opening pattern, spray opening hole size, and relative distance between holes as described, nozzle has six hole openings that allow the passage of high viscous liquids and gels to pass through and form a spray when the removable actuator is depressed. The shape of each of the six hole openings is preferably circular.

In the initial embodiment disclosed in the parent application, it was discovered that the number of hole openings should be six. If the hole openings are increased in number, the present invention gel and high viscous sprayer will not spray efficiently or will not spray at all. Further, the distance D1 between each of the outer holes 120A, 120B, 120C, 120D, and 120E must be approximately equal and this distance is 0.54 mm to 0.60 mm. Similarly, the distance D2 from center hole 120F to each of the outer holes must be approximately equidistant with this distance from center hole 120F to each of the outer holes being 0.54 mm to 0.60 mm. Lastly, the surface area of each of the hole openings is preferably equal. This allows equal pressure distribution of the internal pressure created during the depressing of actuator 110. The surface area opening for each of the holes is approximately 0.196 $mm^2$ based on the holes having a diameter of 0.5 millimeters (mm) illustrated in FIG. 6 as center hole 120F having a diameter Dc of 0.5 mm and outer holes 120A, 120B, 120C, 120D, and 120E having a diameter Dp of 0.5 mm.

Figure 7:
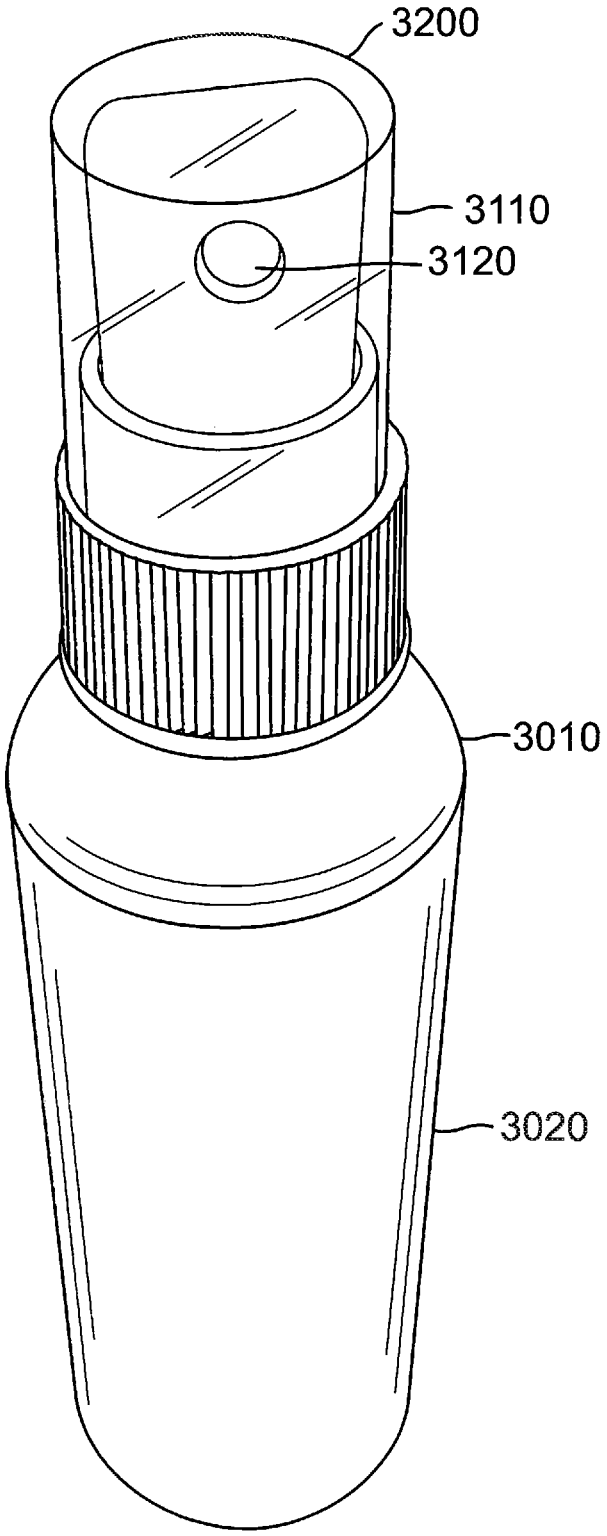
FIG. 7 is a front perspective view of the improved present invention sprayer with aa nozzle opening housing a six-hole spray including a round shaped center opening surrounded by five modified trapezoid shaped openings with the pump sprayer assembly affixed on top of the liquid container and a removable transparent cap placed over the pump sprayer, the spray nozzle removed to show the opening in the actuator where the spray nozzle is located.

Referring to FIG. 7, there is illustrated is a front perspective view of the improved present invention sprayer with a nozzle opening housing a six-hole spray including a round shaped center opening surrounded by five modified trapezoid shaped openings with the pump sprayer assembly affixed on top of the liquid container and a removable transparent cap placed over the pump sprayer, the spray nozzle removed to show the opening in the actuator where the spray nozzle is located.

Figure 8:
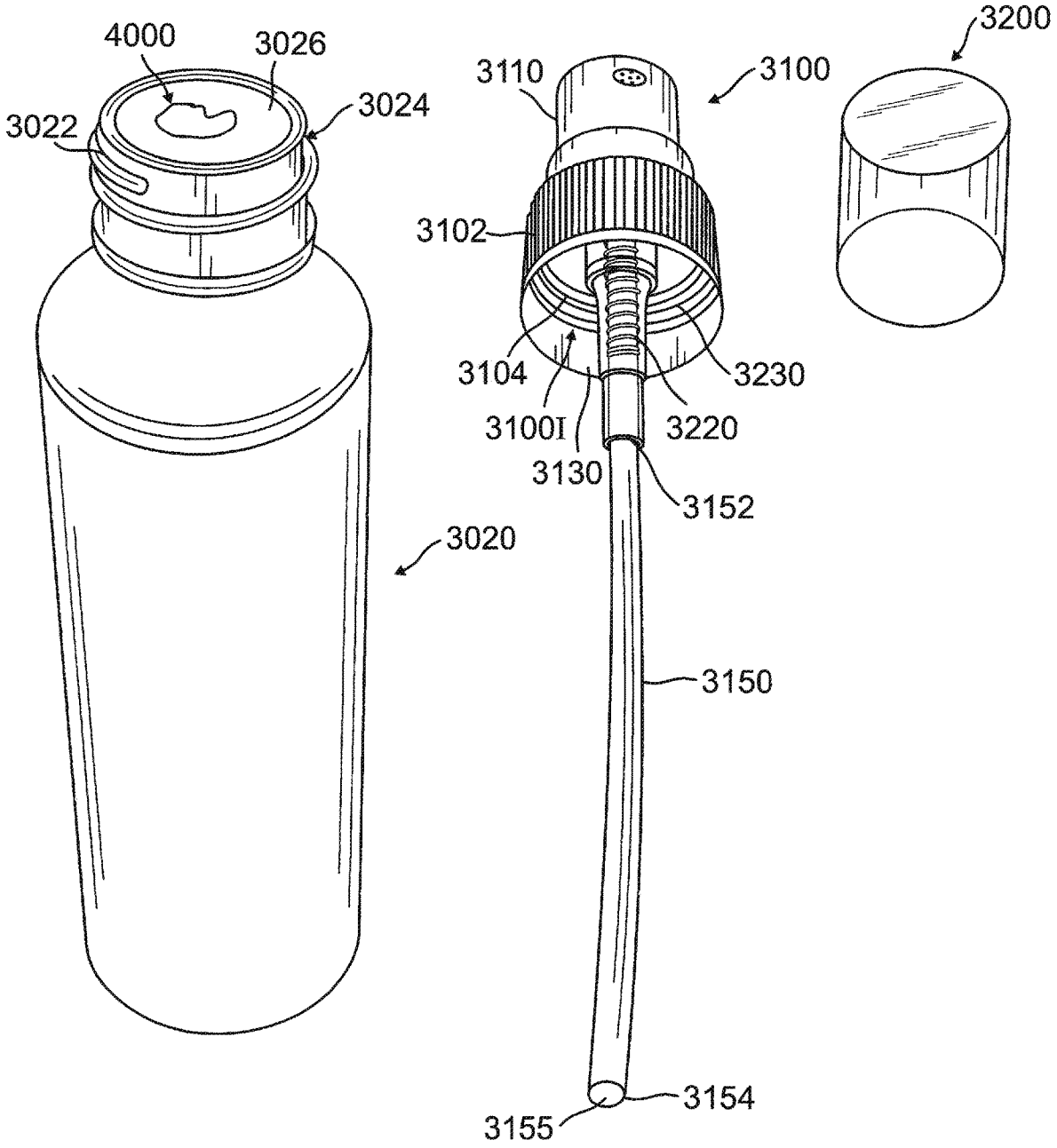
FIG. 8 is an exploded view of the improved present invention sprayer with a six-hole spray pattern illustrating the pump sprayer assembly including a round shaped center opening surrounded by five modified trapezoid shaped openings with the pump sprayer assembly affixed on top of the liquid container and a removable transparent cap placed over the pump sprayer, the spray nozzle removed to show the opening in the actuator where the spray nozzle is located.

Referring to FIG. 8, there is illustrated an exploded view of the improved present invention sprayer with a six-hole spray pattern illustrating the pump sprayer assembly including a round shaped center opening surrounded by five modified trapezoid shaped openings with the pump sprayer assembly affixed on top of the liquid container and a removable transparent cap placed over the pump sprayer, the spray nozzle removed to show the opening in the actuator where the spray nozzle is located.

Figure 9:
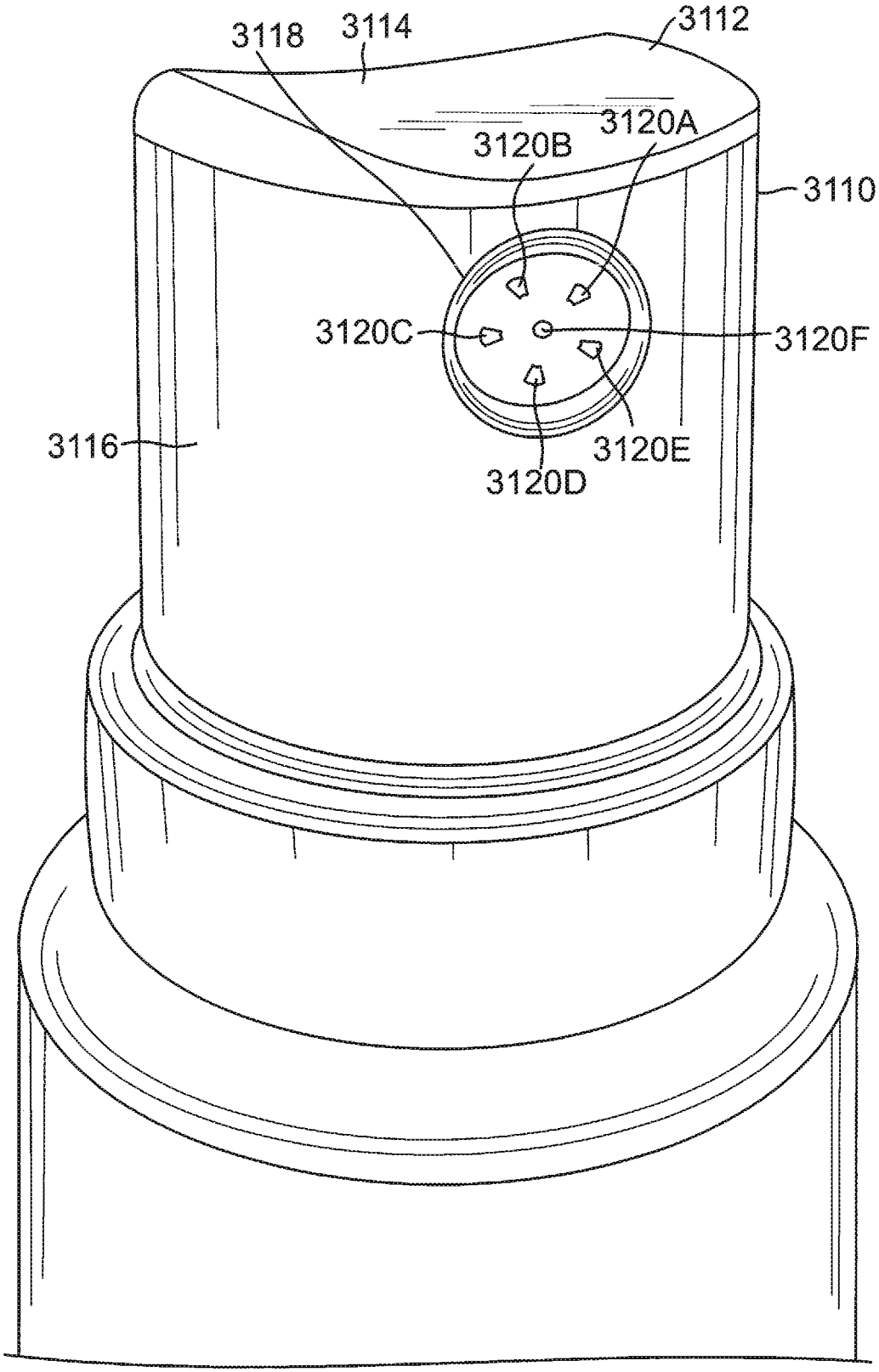
FIG. 9 is a close up view of the improved present invention pump sprayer assembly illustrating the pump sprayer assembly including a round shaped center opening surrounded by five circumferential modified trapezoid shaped openings, with the six holes that extend away from one of the pump sprayer's vertical walls and located just below the actuator.
Figure 9A:
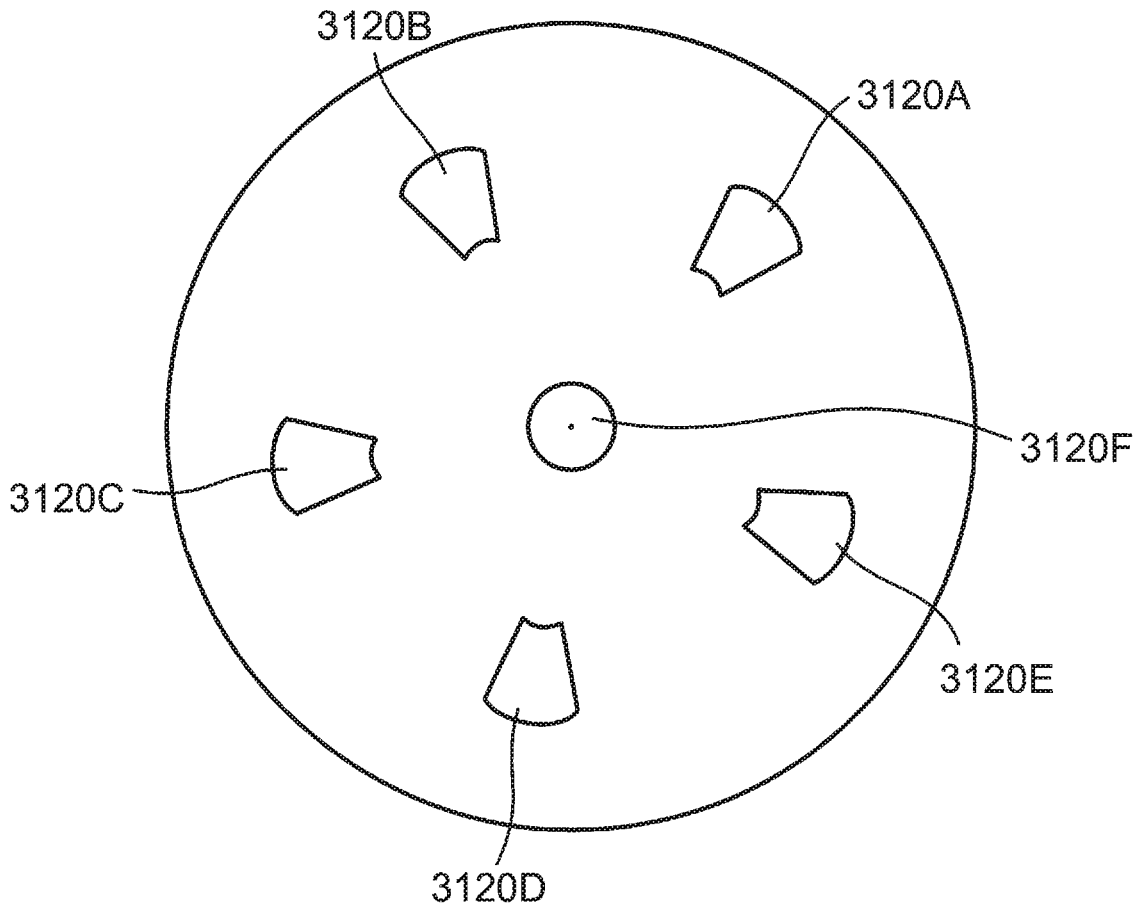
FIG. 9A is an enlarged view of the present invention spray hole assembly illustrated in FIG. 9.

Referring to FIG. 9, there is illustrated a close up view of the improved present invention pump sprayer assembly illustrating the pump sprayer assembly including a round shaped center opening surrounded by five circumferential modified trapezoid shaped openings, with the six holes that extend away from one of the pump sprayer's vertical walls and located just below the actuator. An enlarged view of the six spray nozzle is illustrated in FIG. 9A.

As described in the summary of the invention section, in this continuation-in-part application, the improved design and configuration of the nozzle openings create an optimal consistent jet spray pattern. For facilitating an understanding of the improvements, 3000 has been added to each corresponding part number. Referring to FIG. 7, there is illustrated the improved present invention six-hole sprayer 3010 completely assembled with a liquid container 3020 located on the lower portion of the invention. Directly above the liquid container 3020 is the pump sprayer assembly 3100 (see FIG. 8) with the sprayer cap 3200 located above pump sprayer assembly 3100 and above the container 3020. The improved pump sprayer assembly is enlarged with the round shaped center opening surrounded by the five modified trapezoid shaped openings.

Referring to FIGS. 8 and 9, pump sprayer assembly 3100 has a removable actuator 3110 having a predominantly flat actuator perimeter top surface 3112 with a central top concave portion 3114 shaped to accept a user's finger or thumb. Removable actuator 3110 extends from flat actuator perimeter top surface 3112 downward to a first actuator vertical circumferential wall 3116. As illustrated in FIG. 9, first actuator vertical circumferential wall 3116 extends inwardly to an interior vertical actuator wall or nozzle 3118. As illustrated in FIGS. 8 and 12, interior vertical actuator wall or nozzle 3118 includes six hole openings including five circumferential modified trapezoidal shaped openings (3120A, 3120B, 31200, 3120D, and 3020E), surrounding round central opening and 3120F through which the substance 4000 (see FIG. 8) in the container 3020 passes through and exits the present invention six-hole sprayer 3010 when removable actuator 3110 is depressed by a user.

Referring to FIGS. 7, 8 and 9, the improved pump sprayer assembly 3100 is located above liquid container 3020. Pump sprayer assembly 3100 is removably affixed to liquid container 3020 by liquid container threads 3022 on its nozzle 3024 that mate with pump sprayer assembly threads 3230 on the interior surface 3130 of cap 3102 of pump sprayer assembly 3100. These threads may be either male or female interlock threads on either the liquid container nozzle 3024 or pump sprayer assembly 3100. Liquid container 3020 has an opening 3026 that straw or longitudinal hollow tube 3150 extends into to extract substance 4000. Straw and longitudinal hollow tube refer to the same part 3150.

Figure 10:
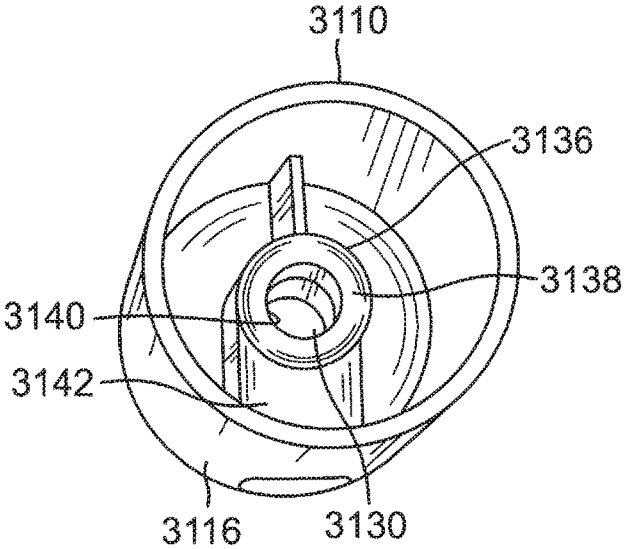
FIG. 10 is a close-up separated view of the top portion of the improved pump sprayer assembly with the actuator removed and the actuator positioned adjacent to the pump sprayer assembly with the actuator top surface facing downward.
Figure 10:
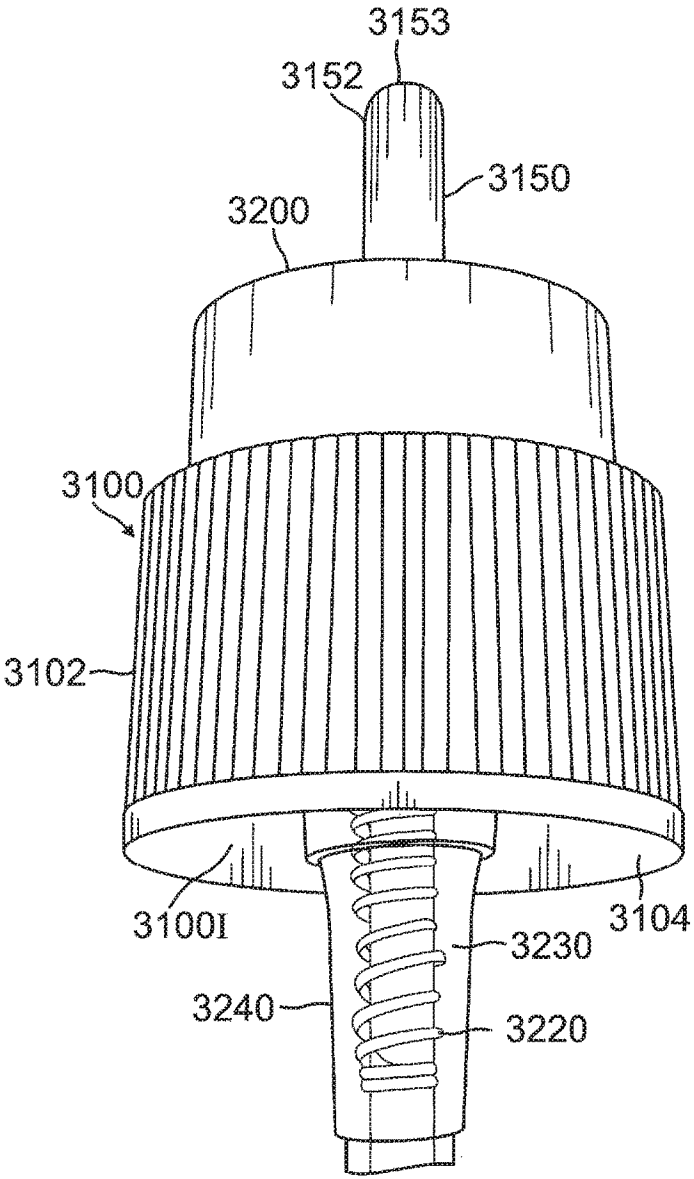

Referring to FIG. 10, there is illustrated a close-up separated view of the top portion of the improved pump sprayer assembly with the actuator removed and the actuator positioned adjacent to the pump sprayer assembly with the actuator top surface facing downward;

Referring to FIGS. 7, 9 and 10, pump sprayer assembly 3100 has a straw 3150 that extends from a straw proximal end 3152 to a straw distal end 3154 having a distal opening 3155. In the fully assembled condition as illustrated in FIG. 7, straw proximal end 3152 has a straw upper opening 3153 retained within an actuator interior vertical circumferential wall 3136. Actuator interior vertical circumferential wall 3136 extends upwardly from a vertical chamber lower elevation or bottom elevation 3138 to a vertical chamber upper elevation 3140. At vertical chamber upper elevation 3140, actuator interior circumferential vertical wall 3136 transitions to an actuator interior circumferential horizontal wall 3142. Collectively, actuator interior circumferential vertical wall 3136 and interior circumferential horizontal wall 3142 form an integrally connected "L"-shaped valve that encloses actuator interior chamber 3130 and allows gel or viscous liquid 4000 to pass from opening 3155 in distal end 3154 of straw 3150 through straw 3150 and up through straw proximal end 3152 through opening 3153 and to previously described present invention hole openings 3120A, 3120B, 3120C, 3120D, 3120E, and 3120F. Round central jole opening 3120F is centrally located on actuator opening 3120 (see FIG. 1) of the improved pump sprayer assembly 3100 and circumferential modified trapezoidal shaped hole openings 3120A, 3120B, 3120C, 3120D, and 3120E are positioned equidistant around central hole opening 3120F. The shape of the hole openings 3120A, 3120B, 3120C, 3120D, 3120E, and 3120F has been defined. However, it is within the spirit and scope of this invention for these hole openings to be of shapes other than round and modified trapezoidal such as rectangular.

Referring to FIGS. 7, 8, and 9, pump sprayer assembly 3100 has a pump circumferential exterior wall 3102 and a pump circumferential interior wall 3104 that surrounds an interior chamber 3100I. Centrally located within interior chamber 3100I is the fluid pump 3200. Fluid pump 3200 consists of a piston 3230 and a spring 3220 that are housed inside of a cylinder 3240. The present invention includes the fluid pump, but primarily the improvement over the prior art fluid pump includes the size, location, and number of the present invention nozzle holes which allows gels and high viscous liquids to be efficiently sprayed. The details of the size, location, and number of these holes will be discussed below. The viscous liquids and gels having a psi of over 100 is selected from the group consisting of hand sanitizer, pain relieving spray, sunscreen and cooking oil.

Figure 11A:
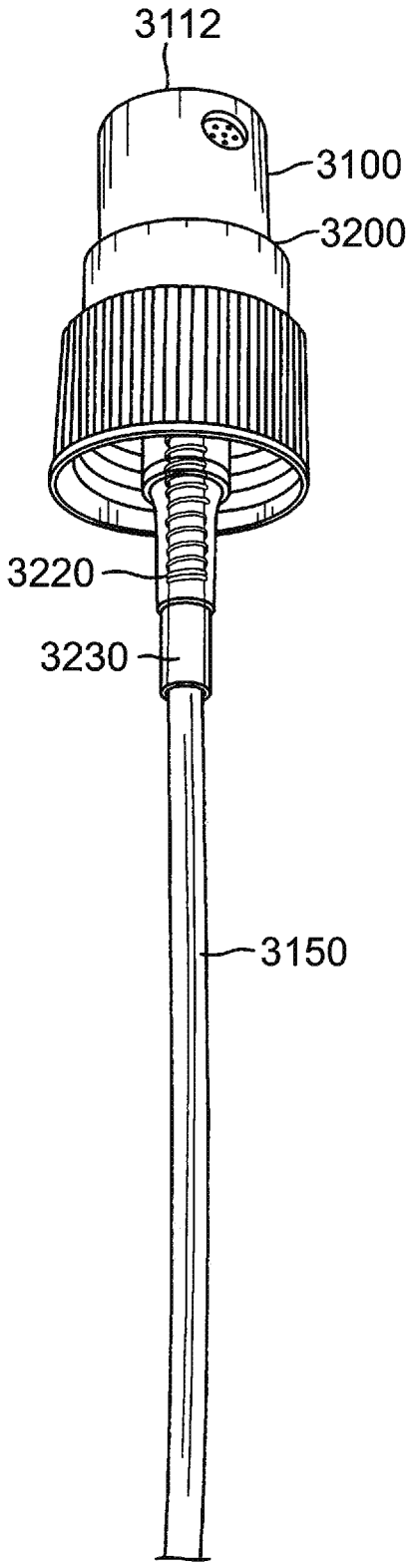
FIG. 11A is a view of the improved present invention pump sprayer assembly with the six holes enlarged for a clearer view of the round shaped center opening surrounded by five circumferential modified trapezoid shaped openings with the actuator in the resting position prior to being depressed.
Figure 11B:
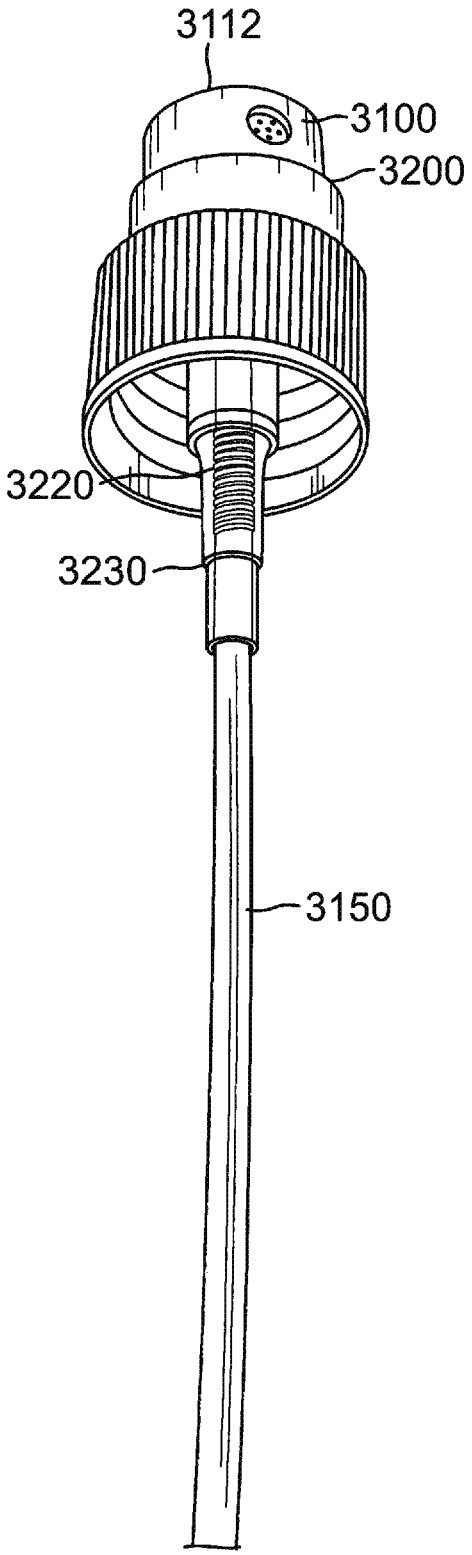
FIG. 11B is a view of the improved present invention pump sprayer assembly with the six holes enlarged for a clearer view of the round shaped center opening surrounded by five circumferential modified trapezoid shaped openings with the actuator in the compressed condition after the actuator has been depressed.

Referring to FIGS. 11A (actuator released) and 11B (actuator depressed), the operation of fluid pump 3200 is performed by a user depressing interior surface 3114 surrounded by flat actuator top surface 3112 of actuator 3110. When actuator 3110 is depressed, it forces piston 3200 (FIG. 10) to compress spring 3220 which reduces the amount of volume in cylinder 3230. This reduction of volume in cylinder 3230 and forces the liquid or gel within the upper portion of straw 3150 to be forced upward through interior chamber 3130, through opening 3153 and out of present invention defined hole openings 3120A, 3120B, 3120C, 3120D, 3120E, and 3120F. When actuator 3110 is released, piston 3200 (FIG. 11B) moves upward from the force of spring 3220 moving from a compressed condition to its initial or starting position. The movement of piston 3200 downward creates a suction force that pulls gel or high viscous liquid 4000 into opening 3155 of straw distal end 3154, through straw 3150 to straw proximal end 3152 and through straw opening 3153.

Figure 12A:
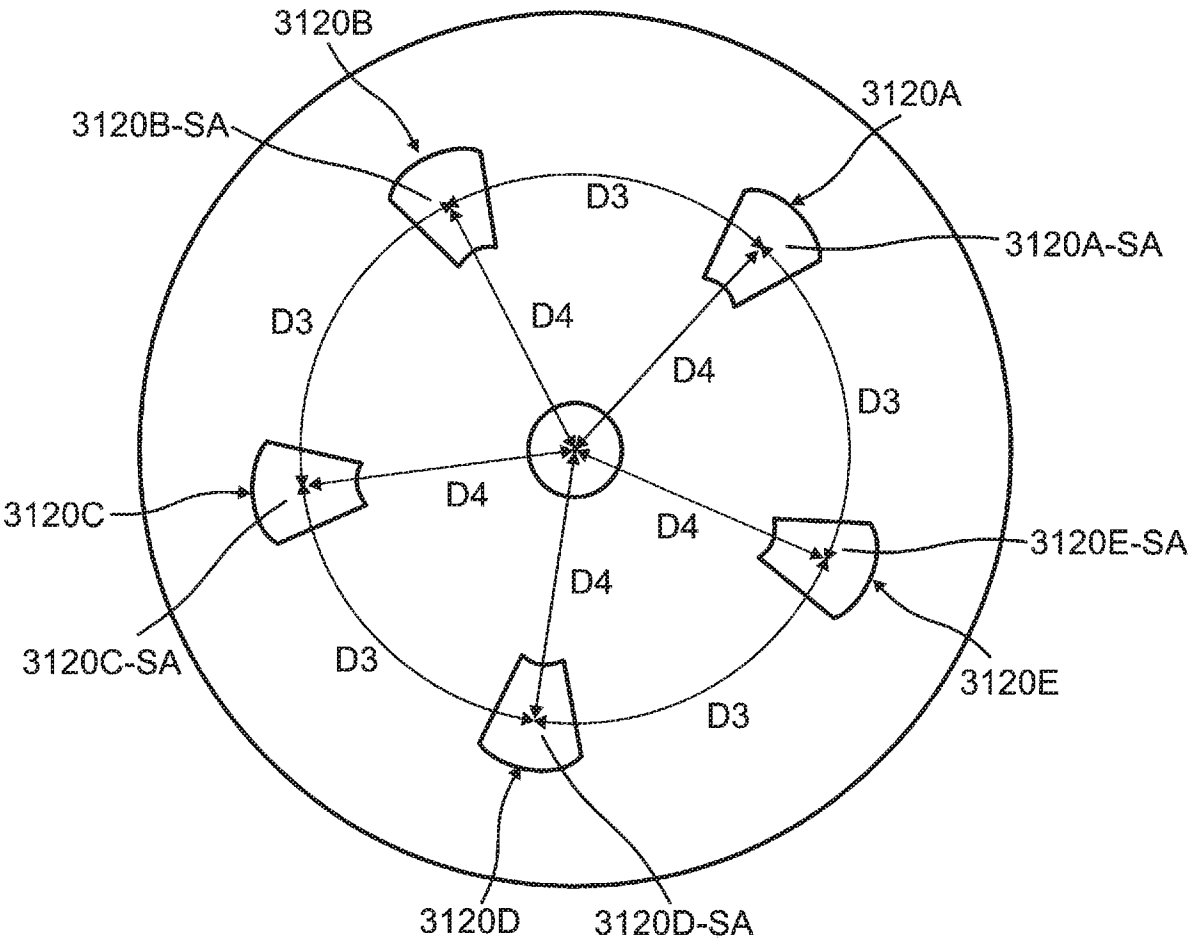
FIG. 12A is a schematic of the improved present invention nozzle of the sprayer pump sprayer assembly with the six holes enlarged for a clearer view of the round shaped center opening surrounded by five circumferential modified trapezoid shaped openings illustrating the dimensions of the six holes and the distances between the holes.
Figure 12B:
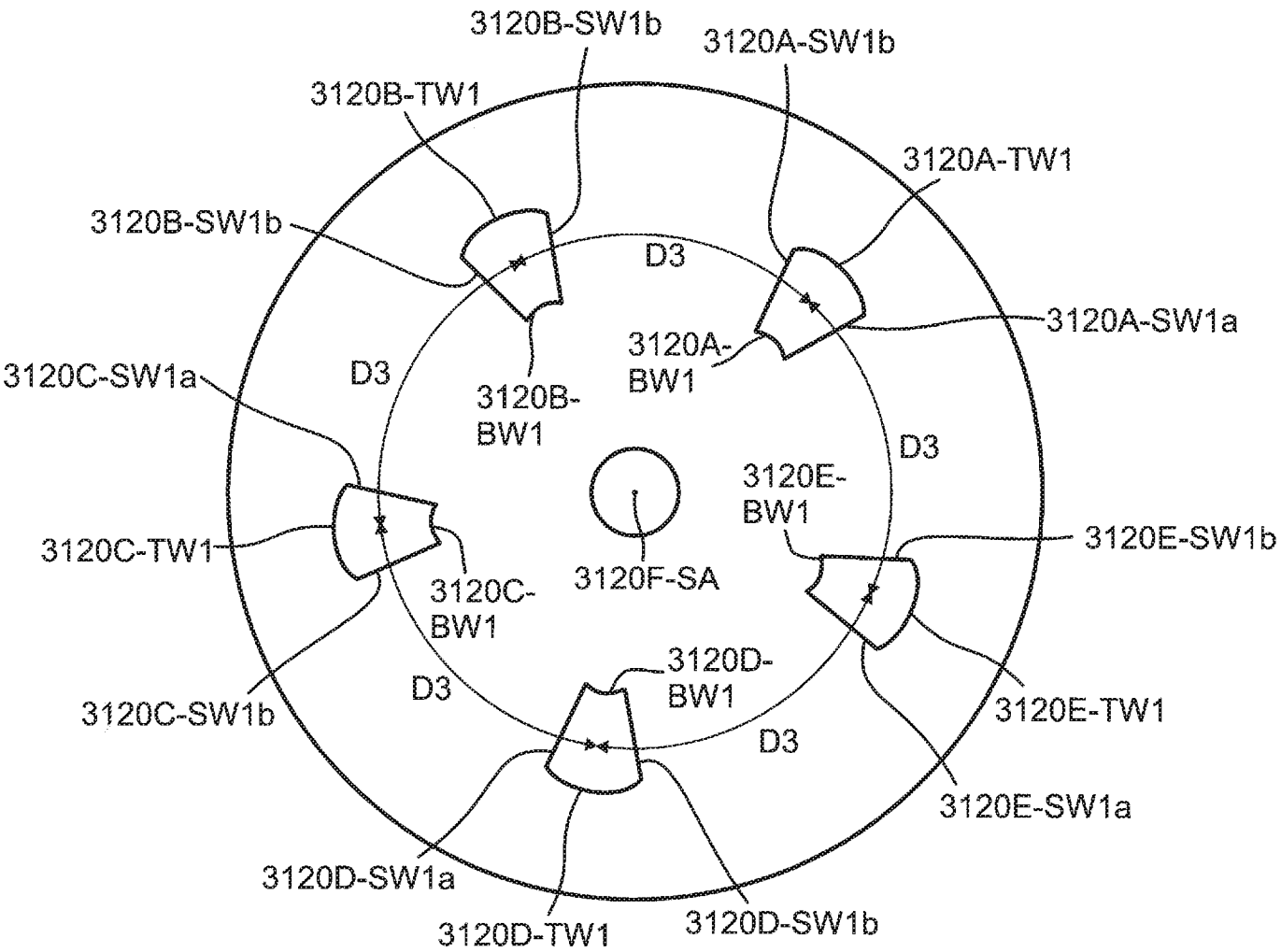
FIG. 12B is taken from FIG. 12A to provide more room for numbering parts of the schematic of the improved present invention nozzle of the sprayer pump sprayer assembly with the six holes enlarged for a clearer view of the round shaped center opening surrounded by five circumferential modified trapezoid shaped openings illustrating the dimensions of the six holes and the distances between the holes.

Referring to FIGS. 12A and 12B, there is illustrated a schematic of the present invention nozzle 3118. The improved nozzle includes one centrally located hole opening 3120F and five outer hole openings 3120A, 3120B, 3120C, 3120 D, and 3120E around the one centrally located hole opening 3120F. In a preferred embodiment, each of the openings is the same size. The improved nozzle includes a round hole 3120F at the nozzle middle-center location, the round hole having a preferred diameter Dc of 0.500 mm and a preferred surface area 3120F-SA of 0.196 mm squared. The center round hole is surrounded by five circumferential modified trapezoidal shaped hole openings 3120A, 3120B, 3120C, 3120D and 3120E, with each of the respective circumferential modified trapezoidal shaped hole openings including 3120A with a surface area of 3120A-SA and a pair of divergent sidewalls 3120A-SW1*a* and 3120A-SW1*b* with an arcuate top wall 3120A-TW1 and a smaller arcuate bottom wall 3120A-BW1; circumferential modified trapezoidal shaped hole opening 3120B with a surface area of 3120B-SA and a pair of divergent sidewalls 3120B-SW1*a* and 3120B-SW1*b* with an arcuate top wall 3120B-TW1 and a smaller acuate bottom wall 3120B-BW1; circumferential modified trapezoidal shaped hole opening 3120C has a surface area of 3120C-SA and a pair of divergent sidewalls 3120C-SW1*a* and 3120C-SW1*b* with an arcuate top wall 3120C-TW1 and a smaller acuate bottom wall 3120C-BW1; circumferential modified trapezoidal shaped hole opening 3120D has a surface area of 3120D-SA and a pair of divergent sidewalls 3120D-SW1*a* and 3120D-SW1*b* with an arcuate top wall 3120D-TW1 and a smaller arcuate bottom wall 3120D-BW1; and a circumferential modified trapezoidal shaped hole opening 3120E has a surface area of 3120E-SA and a pair of divergent sidewalls 3120E-SW1*a* and 3120E-SW1*b* with an arcuate top wall 3120E-TW1 and a smaller arcuate bottom wall 3120E-BW1.

The five circumferential modified trapezoidal shaped openings, also called orifices, are spaced apart by 1.23 mm with a top and bottom radius concentric to the center hole (also called orifice) and evenly spaced D3 at 72 degrees from the center hole's vertical axis and with each of the five circumferential modified trapezoidal shaped openings having the same surface area as just defined of 0.196 mm squared. The distance D4 from a middle-center point of the round center opening to a middle center point of each of the five modified shaped openings is between 0.54 mm and 0.60 mm. With the improved nozzle design, the viscous spray pattern is consistent as a jet spray traveling from two inches to 4 inches for a viscous substance having a viscosity of at least 100 psi. The viscous gel substances which are used with the present invention six-hole sprayer include hand sanitizer, pain relieving spray, sunscreen and cooking oil.

Viscosity is a material property which describes resistance of a fluid to shearing flows and corresponds to thickness.

Each opening for each of the five circumferential modified trapezoidal hole openings is positioned a distance D4 equidistant away from the one centrally located round hole opening 3120F. Each outer hole opening is positioned an equal distance D3 apart from each adjacent outer hole opening. With this unique spray opening pattern, spray opening hole size, and relative distance between holes as described, nozzle has six hole openings that allow the passage of high viscous liquids and gels to pass through and form a jet spray when the removable actuator is depressed.

Through numerous research and design efforts, it was discovered that the number of hole openings should be six. If the hole openings are increased in number, the present invention gel and high viscous sprayer will not spray efficiently or will not spray at all. Further, the distance between each of the outer holes 3120A, 3120B, 3120C, 3120D, and 3120E must be approximately equal and this distance is 1.23 mm. Similarly, the distance D4 from center hole 3120F to each of the outer holes must be approximately equidistant with this distance from center hole 3120F to each of the outer holes being 0.54 mm to 0.60 mm. Lastly, the surface area of each of the hole openings is preferably equal. This allows equal pressure distribution of the internal pressure created during the depressing of actuator 3110. The surface area opening for each of the holes is equal to approximately 0.196 $mm^2$ based on the round center hole having a diameter of 0.5 millimeters (mm) illustrated in FIG. 6 as center hole 3120F having a diameter Dc of 0.5 mm and the circumferential modified trapezoidal shaped holes 3120A, 3120B, 3120C, 3120D, and 3120E have the same surface area.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A hand pump sprayer adapted for use with a container retaining a viscous substance selected from the group consisting of high viscous liquids and high viscous gels having a viscosity of at least 100 psi, the hand pump sprayer comprising:

a. a piston assembly including a pump sprayer assembly, a fluid pump, a sprayer cap, a removable actuator and a nozzle;

b. said pump sprayer assembly partially located above said container retaining said viscous substance, wherein the removable actuator has a top surface;

c. said removable actuator extending from said top surface downward to a first actuator vertical circumferential wall and said first actuator vertical circumferential wall extending inwardly to said nozzle;

d. said nozzle consisting of six hole openings;

e. said six hole openings in said nozzle consisting of one round centrally located hole opening and five circumferential modified trapezoidal shaped hole openings positioned around the one round centrally located hole opening;

f. each of the five circumferential modified trapezoidal shaped hole openings having equally sized openings;

g. the one round centrally located hole opening and the five circumferential modified trapezoidal shaped hole openings all having an equally sized surface area;

h. each of the five circumferential modified trapezoidal shaped hole openings is positional equidistant away from the one round centrally located hole opening;

i. the distance between a middle-center location of the one round centrally located hole opening and a middle-center location of each of the five circumferential modified trapezoidal shaped hole openings is between 0.54 mm and 0.60 mm;

j. each of the five circumferential modified trapezoidal shaped hole openings are spaced apart by 1.23 mm with a top and bottom radius concentric to the one round centrally located hole opening and evenly spaced at 72 degrees in a circumference around said one round centrally located hole opening;

k. the one round centrally located hole opening having a diameter of 0.5 mm; and l. said pump sprayer assembly further including a straw that extends from a straw distal end with a distal opening within said container retaining the viscous substance and extending to a straw proximal end with said straw proximal end having a straw upper opening retained within an actuator interior vertical circumferential wall in fluid communication with said six hole openings in said nozzle;

m. wherein, said six hole openings in the respective size, shape, positioning relative to each other, distance from each other, surface area, and configuration as defined in elements (d) through (k) together maintain a dispensing pressure at a level that is necessary to provide an even spray pattern of said viscous substance passing through said six hole openings and allow equal pressure distribution when the removable actuator is depressed.

2. The hand pump sprayer in accordance with claim 1, wherein said viscous liquid and viscous gel is selected from the group consisting of: hand sanitizer, pain relieving spray, sunscreen and cooking oil.

3. The hand pump sprayer in accordance with claim 1, wherein said one centrally located round hole opening having a surface area for the hole opening equal to each respective surface area of each of the five circumferential modified trapezoidal shaped hole openings, wherein said surface area of said one centrally located round hole and said surface area of each of said five circumferential modified trapezoidal shaped hole openings being 0.196 $mm^2$.

4. The hand pump sprayer in accordance with claim 1, further comprising:

a. said pump sprayer assembly further including said straw that extends from a straw distal end with said distal opening within said container retaining the viscous substance and extending to said straw proximal end with said straw proximal end having said straw upper opening retained within said actuator interior vertical circumferential wall with said actuator interior vertical circumferential wall extending upwardly from said vertical chamber lower elevation to said vertical chamber upper elevation;

b. said actuator interior circumferential vertical wall transitions to an actuator interior circumferential horizontal wall at said vertical chamber upper elevation;

c. said actuator interior circumferential vertical wall and said interior circumferential horizontal wall integrally connected to form an integrally connected "L"-shaped valve that encloses an actuator interior chamber; and d. said "L"-shaped valve allows said viscous substance to pass from said opening in said distal end of said straw to be in fluid communication with said six hole openings in said nozzle.

5. The hand pump sprayer in accordance with claim 4, further comprising:

a. the fluid pump includes a piston and a spring that are housed inside of a cylinder;

b. said piston located above a spring within said pump sprayer assembly; and c. said removable actuator is located above said pump sprayer assembly.

6. A hand pump sprayer having a viscous substance container retaining a viscous substance having a viscosity of 100 psi to 1000 psi, the hand pump sprayer including an apparatus to pump the viscous substance out of the viscous substance container through a nozzle, the nozzle consisting of:

a. one centrally located hole opening and five circumferential hole openings, said one centrally located hole opening having a different shape than said five circumferential hole openings;

b. said one centrally located hole opening having a round shape and having a diameter of 0.500 mm;

c. each of said five circumferential hole openings having a modified trapezoidal shape comprising:

I. a pair of divergent sidewalls;

II. an arcuate top wall;

III. an arcuate bottom wall, wherein the arcuate bottom wall is smaller than the arcuate top wall;

IV. a top radius concentric to said one centrally located hole; and

V. a bottom radius concentric to said one centrally located hole;

d. wherein a distance from a middle center point of said one centrally located hole opening to a middle center point of each of said five circumferential hole openings being between 0.54 mm and 0.60 mm;

e. wherein said five circumferential hole openings are evenly spaced from each other at a distance of 1.23 mm and at an angle of 72 degrees from a vertical axis of said one centrally located hole opening;

f. wherein the surface area of said one centrally located hole opening and the surface area of each of the five circumferential hole openings is 0.196 $mm^2$; and g. wherein, the six hole openings in the respective size, shape, positioning relative to each other, distance from each other, surface area, and configuration as defined in elements (a) through (f) together maintain a dispensing pressure at a level that is necessary to provide an even spray pattern of the viscous substance passing through the six hole openings and allow equal pressure distribution when the actuator is depressed.

7. A hand pump sprayer adapted for use with a container retaining a viscous substance selected from the group consisting of high viscous liquids and high viscous gels having a viscosity of at least 100 psi, the hand pump sprayer comprising:

a. a nozzle consisting of six hole openings;

b. said six hole openings in said nozzle consisting of one round centrally located hole opening and five circumferential modified trapezoidal shaped hole openings positioned around the one round centrally located hole opening;

c. each of the five circumferential modified trapezoidal shaped hole openings having equally sized openings;

d. the one round centrally located hole opening and the five circumferential modified trapezoidal shaped hole openings all having an equally sized surface area;

e. each of the five circumferential modified trapezoidal shaped hole openings is positional equidistant away from the one round centrally located hole opening;

f. the distance between a middle-center location of the one round centrally located hole opening and a middle-center location of each of the five circumferential modified trapezoidal shaped hole openings is between 0.54 mm and 0.60 mm;

g. each of the five circumferential modified trapezoidal shaped hole openings are spaced apart by 1.23 mm with a top and a bottom radius concentric to the one round centrally located hole opening and evenly spaced at 72 degrees around a circumference of said one round centrally located hole opening; and h. the one round centrally located hole opening having a diameter of 0.5 mm;

i. wherein, said six hole openings in the respective size, shape, positioning relative to each other, distance from each other, surface area, and configuration as defined in elements (a) through (h) provide together maintain a dispensing pressure at a level necessary to provide an even spray pattern of said viscous substance passing through and out of said six hole openings when an actuator of the hand pump sprayer is depressed.

8. The hand pump in accordance with claim 7, wherein said viscous substance is selected from the group consisting of: viscous liquid and viscous gel.

9. The hand pump sprayer in accordance with claim 8, wherein said viscous substance is selected from the group consisting of: hand sanitizer, pain relieving spray, sunscreen and cooking oil.

10. A hand pump sprayer adapted for use with a container retaining a viscous substance having a viscosity of at least 100 psi, the hand pump sprayer comprising:

a. a nozzle consisting of six hole openings;

b. said only six hole openings in said nozzle consisting of one round centrally located hole opening and only five circumferential hole openings positioned around the only one round centrally located hole opening, wherein each of the only five circumferential hole openings is selected form the group consisting of modified trapezoid shaped, rectangular shaped, and parallelogram trapezoid shaped;

c. each of the only five circumferential hole openings having equally sized openings;

d. the only one round centrally located hole opening and the only five circumferential hole openings all having an equally sized surface area;

e. each of the only five circumferential hole openings is positional equidistant away from the only one round centrally located hole opening;

f. the distance between a middle-center location of the only one round centrally located hole opening and a middle-center location of each of the only five circumferential hole openings is the same; and g. each of the only five circumferential hole openings are evenly spaced apart with a top and bottom radius concentric to the only one round centrally located hole opening and evenly spaced at 72 degrees forming a circumference around said only one round centrally located hole opening;

h. wherein, said only six hole openings as defined in elements (a) through (g) together maintain a dispensing pressure at a level that is necessary to provide an even spray pattern of said viscous substance passing through and out of said only six hole openings and allow equal pressure distribution when an actuator of the hand pump sprayer is depressed.

11. The hand pump in accordance with claim 10, wherein said viscous substance is selected from the group consisting of: viscous liquid and viscous gel.

12. The hand pump in accordance with claim 11, wherein said viscous substance is selected from the group consisting of: hand sanitizer, pain relieving spray, sunscreen and cooking oil.

13. The hand pump sprayer in accordance with claim 10, wherein each of the only five circumferential hole openings is modified trapezoid shaped.

14. The hand pump sprayer in accordance with claim 10, wherein each of the only five circumferential hole openings is rectangular shaped.

15. The hand pump sprayer in accordance with claim 10, wherein each of the only five circumferential hole openings is parallelogram trapezoid shaped.

* * * * *